United States Patent [19]

Nicholson et al.

[11] Patent Number: 4,469,213

[45] Date of Patent: Sep. 4, 1984

[54] COIN DETECTOR SYSTEM

[76] Inventors: Raymond Nicholson, 817 Industrial Dr., Elmhurst, Ill. 60126; Donald O. Parker, 509 S. Division Ave., Grand Rapids, Mich. 49503

[21] Appl. No.: 387,820

[22] Filed: Jun. 14, 1982

[51] Int. Cl.[3] ..... G07D 5/08

[52] U.S. Cl. ..... 194/100 A; 324/236

[58] Field of Search ..... 194/100 A, 100 R, 99, 194/97 R; 73/163; 324/236

[56] References Cited

U.S. PATENT DOCUMENTS

| | | | |
|---|---|---|---|
| 3,059,749 | 10/1962 | Zinke . | |
| 3,481,443 | 12/1969 | Meloni . | |
| 3,599,371 | 8/1971 | Hinterstocker . | |
| 3,741,363 | 6/1973 | Hinterstocker . | |
| 3,796,295 | 3/1974 | Montolivo et al. | 194/100 A |
| 3,837,454 | 9/1974 | Joeck | 194/100 A X |
| 3,870,137 | 3/1975 | Fougere . | |
| 4,254,857 | 3/1981 | Levasseur et al. | 194/100 A |

FOREIGN PATENT DOCUMENTS

| | | | |
|---|---|---|---|
| 2069211 | 2/1980 | United Kingdom | 73/163 |

*Primary Examiner*—F. J. Bartuska

*Attorney, Agent, or Firm*—Leydig, Voit, Osann, Mayer & Holt, Ltd.

[57] ABSTRACT

An electronically controlled coin tester which positions a sample coin in a magnetic field then passes a test coin through a similar magnetic field to create a null in a detector coil sensing the fields. The output of a square wave oscillator is differentiated to generate a spiked signal for exciting the magnetic field. The presence of the test coin is detected by sensing the quality of the null and test coin is accepted in response to the duration of the null. Preferably, a capacitor is charged in the absence of the test coin and discharged in the presence of the test coin and the test coin is accepted in response to the amount of energy stored in the capacitor at the time the null is produced. In addition, a pendulum damper is provided for engaging the test coin prior to its entry into the magnetic field and variably retarding the test coin in response to the coin size.

5 Claims, 11 Drawing Figures

COIN DETECTOR SYSTEM

This invention relates to coin testing devices, and more particularly to an improved electronically controlled coin tester.

There are many, many kinds of coin operated devices and also many, many ways to attempt to cheat them. Several which come to mind are slugs, foreign coins, the retrievable coin-on-a-string, etc. As a result, there are many, many kinds of coin testing devices which attempt to discriminate between acceptable coins and those which are not.

The art is crowded with electrical, electronic and mechanical coin testing devices capable of fulfilling their purpose to a greater or lesser extent. Among the many approaches is the magnetic matching scheme described in Hinterstocker U.S. Pat. Nos. 3,599,771 and 3,741,363. Both patents deal with a three coil stack for creating a pair of magnetic fields in the two gaps between the three stacked coils. A sample coin is placed in one gap and a coin to be tested is passed through the second gap. Electronic circuitry monitors the magnetic fields to attempt to determine if the tested coin matches the sample coin using the attenuation characteristics of the coins as criteria.

The earlier issued patent describes a scheme whereby the testing electronics are switched on for only the brief instant when the coin is in test position. The later issued patent points out some of the problems with that approach and instead proposes a scheme which relies on sensing a null created when an acceptable coin passes through the magnetic field. Any coin which causes the system to null will be accepted unless the coin causes two nulls within a predetermined interval.

As commercially applied, the electronic coin tester described in those patents is used with a mechanical slug rejector, suggesting that the electronics does not do all of the testing.

In view of the foregoing, it is a general aim of the present invention to provide an electronically controlled coin tester which needs no auxiliary mechanical devices, and which has superior selectability.

An object of the present invention is to provide an electronically controlled coin tester which senses not only the attenuation characteristics of the coins, but also the speed of travel of the tested coin.

According to certain aspects of the invention, it is an object to provide an electronically controlled coin tester for matching a tested coin against a sample coin having the ability to quickly and simply replace the sample coin and thereby the denomination of the coins accepted.

Other objects and advantages will become apparent with reference to the following description when taken in conjunction with the drawings, in which.

FIGS. 8*a*–8*d* illustrates wave forms produced during operation of the coin tester.

While the invention will be described in connection with a preferred embodiment, there is no intent to limit it to that embodiment. On the contrary, the intent is to cover all alternatives, modifications and equivalents included within the spirit and scope of the invention as defined by the appended claims.

Figure 1:
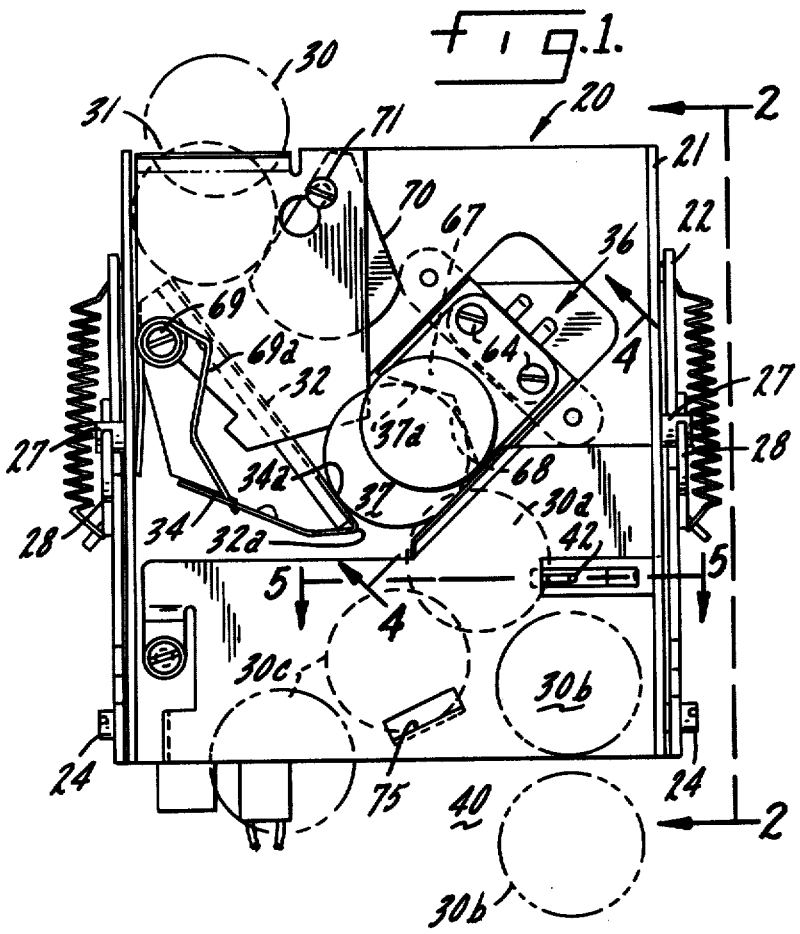
FIG. 1 is a front elevation showing an electronically controlled coin tester constructed in accordance with the present invention.
Figure 2:
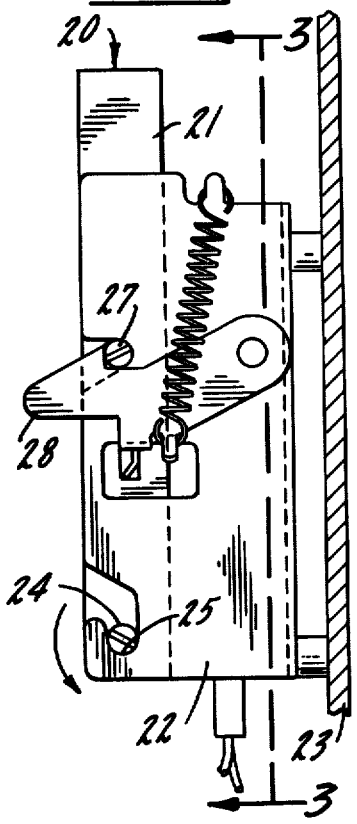
FIG. 2 is a side elevation of the coin tester of FIG. 1 taken along the line 2—2.
Figure 3:
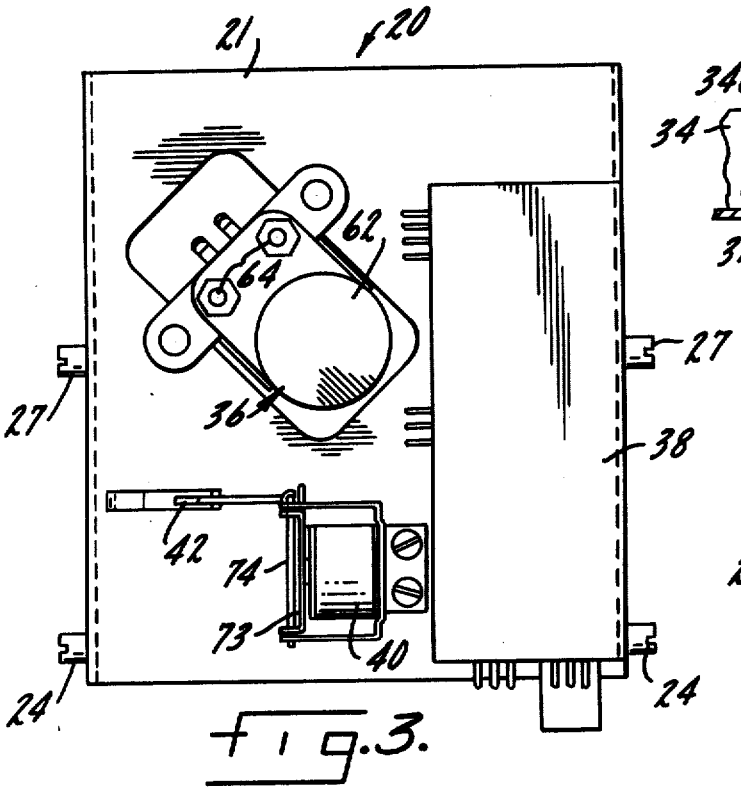
FIG. 3 is a partial rear elevation with back plate removed taken generally along the line 3—3 of FIG. 2.

Turning now to the drawings, and particularly to FIGS. 1–3, the major mechanical elements of the coin tester are illustrated. The coin tester 20 is built on a base plate 21 mounted for ready removal to a C-shaped mounting bracket 22 which in turn can be affixed to a convenient mounting surface 23 within a coin operated device. A pair of pins 24 on the base plate 21 are engaged in slots 25 in the mounting bracket 22. A further pair of pins 27 are engaged by spring loaded clamps 28 to firmly hold the base plate 21 on the C-shaped bracket 22. However, by simply depressing the spring loaded clamps 28, the base plate with its attached components can be removed to clear jams, make repairs or the like.

The tester 20 is adapted to receive a coin schematically illustrated at 30 from a coin chute (not shown) in a coin operated device (also not shown). The coin 30 enters a slot 31 in the coin tester and rolls down an incline 32 established by adjustable sample coin holder 34. As the coin rolls down the incline 32, it passes through a magnetic sensing assembly generally indicated at 36 at which point it is compared to a sample coin 37 held within the sensing assembly by the holder 34. Electronic circuitry within enclosure 38 serves to determine whether the test coin 30 matches the sample coin 37 in order to make a decision on whether or not to accept the coin. As the coin leaves the end portion **32*a* of the ramp 32, it follows a trajectory suggested by 30*a* toward a reject chute generally indicated at 40. If the coin characteristics did not match those of the test coin, the coin would simply follow the indicated trajectory suggested by phantom coins 30*b*** and be returned to the depositor as unacceptable.

If, however, the electronics within the enclosure 38 determined that the characteristics of the test coin 30 matched the sample coin 37, electromagnet 40 would be energized moving a kicker arm 42 into the path of the coin 30 at about position **30*a*. The kicker arm 42 would thus prevent the coin from following the path previously illustrated as 30*b* and would instead cause the coin to follow the path suggested by 30*c***. The end result would be the deposit of the coin in the coin box and the operation of the machine in accordance with its normal function.

Figure 4:
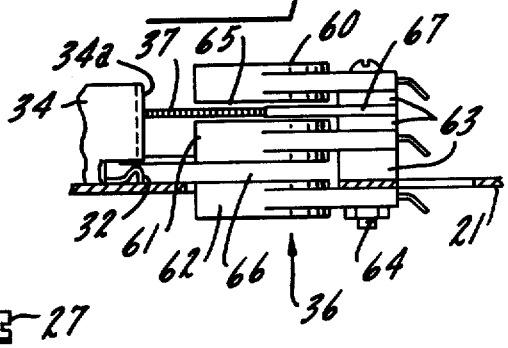
FIG. 4 is a partial sectional view showing the coil mechanism and coin holder taken along the line 4—4 of FIG. 1.

In accordance with one aspect of the invention, the relationship between the sensing coil assembly 36 and the structure which holds the sample coin and guides the test coin is specially configured to produce a simple, serviceable and easily alterable coin mechanism while at the same time enhancing its ability to distinguish between acceptable and unacceptable coins. Referring to FIG. 4, there is shown the coil assembly 36 made up of three individual coils 60, 61 and 62 separated by spacers 63 and affixed at 64 to the base plate 21. Thus, two gaps 65, 66 are created between the coils in which are produced similar magnetic fields. In the gap 65, there is affixed a coin positioner 67 which defines a position for a portion of the periphery of the sample coin 37. As viewed in FIG. 1, the coin positioner 67 has a V-shaped face 68 which contacts a portion of the periphery 37*a* of the test coin 37.

Cooperating with that structure is the pivotable coin holder 34, shown in FIG. 1 to be pivoted at 69 and spring loaded at 69*a* toward the V-shaped face 68 of the coin positioner 67. A surface 34*a* of the coin holder 34 engages the periphery of the test coin 37 and forces it into the V-shaped notch 68, thus assuring it remains in a known position. Whenever it is desired to change a test coin such as to make the machine operate for coins of a different denomination, it is simply necessary to pivot the holder 34 against its spring loaded pressure, remove the sample coin 37 and insert another. The center of the pivot point 69, the orientation of the V-shaped notch 68, and the location of the surface 34*a* are coordinated so that coins having a reasonable range of diameters will be properly positioned within the slot 65 for comparison against test coins.

Returning to FIG. 4, it is seen that the slot 66 is provided for passage of the test coin through the magnetic sensors. The ramp surface 32 is a formed metal section and is on the same level with and parallel to the sample coin holding surface 34*a*, to establish a common plane for the two coins to be compared. Thus, as the test coin rolls along the ramp 32, it will pass through the slot 66 while penetrating into the magnetic field created in the slot by exactly the same amount as the fixed penetration of the sample coin 37 (assuming, of course, that the test coin matches the sample coin in size). Furthermore, when the mechanism is set up for a coin of different size, that relationship is retained by virtue of the common plane automatically achieved by the structure of the adjustable sample coin holder and test coin ramp.

It is important to note that the angle of the ramp 32 is dependent on the size of the coin being sought. If a device is used with coins smaller than those illustrated in the drawings, the ramp 32 becomes more horizontal, thereby causing the test coin to travel through the magnetic field at a slower rate.

As will be made clear in connection with the electronic elements, assuming the test and sample coins are the same, as the test coin passes through the magnetic field it will penetrate the field to the same extent as the sample coin. At that point, the electronics creates a null which is used to generate a signal to accept the coin. The time duration or width of the null is one of the criteria used for determining the acceptability of the test coin. The width of the null in turn is dependent not only on the degree of penetration (the diameter of the coin), but also on the speed of the coin. In order to achieve the same width null when using the coin tester for coins of different size, it is therefore desirable to make coins of smaller diameter travel through the magnetic field more slowly.

In accordance with one aspect of the invention, that is accomplished by the pivotable test coin holder 34 which establishes the common plane 32 for travel of the test coin. For coins of smaller diameter than those illustrated in FIG. 1, the ramp 32 becomes more horizontal and thus causes the smaller coins to travel more slowly through the magnetic field.

As a further aid in speed control, a pendulum damper 70 is pivoted at 71 to engage a coin as it begins its descent down the ramp 32. Since the pendulum 70 is a fixed weight, its retarding effect on coins of larger diameter and thus larger mass will be less. As a result, smaller coins will be retarded to a greater extent than larger coins, further slowing the speed of travel of the smaller coin through the magnetic field.

The aforementioned mechanical features provide a coin tester which can be reset to operate with coins of a different denomination in a matter of seconds. It is simply necessary, to pivot the bracket 34 against spring force, allow the sample coin 37 to fall free, then replace the sample coin with the new sample coin, allowing the mechanism 34 to precisely locate the sample coin in its associated magnetic field while at the same time positioning ramp 32 at an angle optimized for speed control of the new sized coin.

Figure 5:
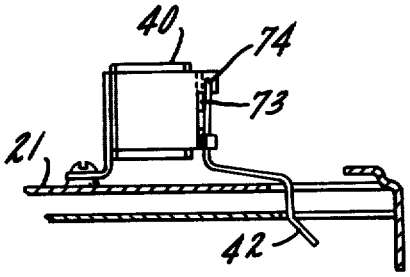
FIG. 5 is a partial sectional view showing the coin kicker taken generally along the line 5—5 of FIG. 3.

It was noted above that a kicker arm 42 controlled the flight of the coin after it left the ramp 32 into either the reject chute or the accept chute. Referring to FIGS. 3 and 5, it is seen that the kicker arm 42 is controlled by a solenoid 40. The solenoid has a plate 73 hinged at 74 to which the kicker arm 42 is fixed. The solenoid is normally de-energized such that any coin leaving the ramp 32 can brush the kicker arm 42 to its rightmost position as shown in FIGS. 1 and 5, thereby entering the reject chute. Whenever the electronics detects an acceptable coin within the magnetic field, the solenoid is operated, bringing the kicker arm to the position illustrated in FIG. 5, thus intercepting the coin as it leaves the ramp at about the 3:00 o'clock to 4:00 o'clock position as viewed in FIG. 1. As a result, the coin is deflected onto a ledge 75 which diverts it through the 30*c* positions into the coin box.

The common plane whose angle is determined by the size of the sample coin is also important in assuring that the kicker arm 42 engages the coin at about the preferred 3:00 to 4:00 o'clock position for consistently diverting it into the accept chute. Since the ramp 32 is pivoted toward the kicker arm for coins of decreasing diameter, coins smaller than those illustrated in FIG. 1 will leave the ramp 32 with a greater horizontal component which causes them to properly engage the kicker arm 42.

Figure 6:
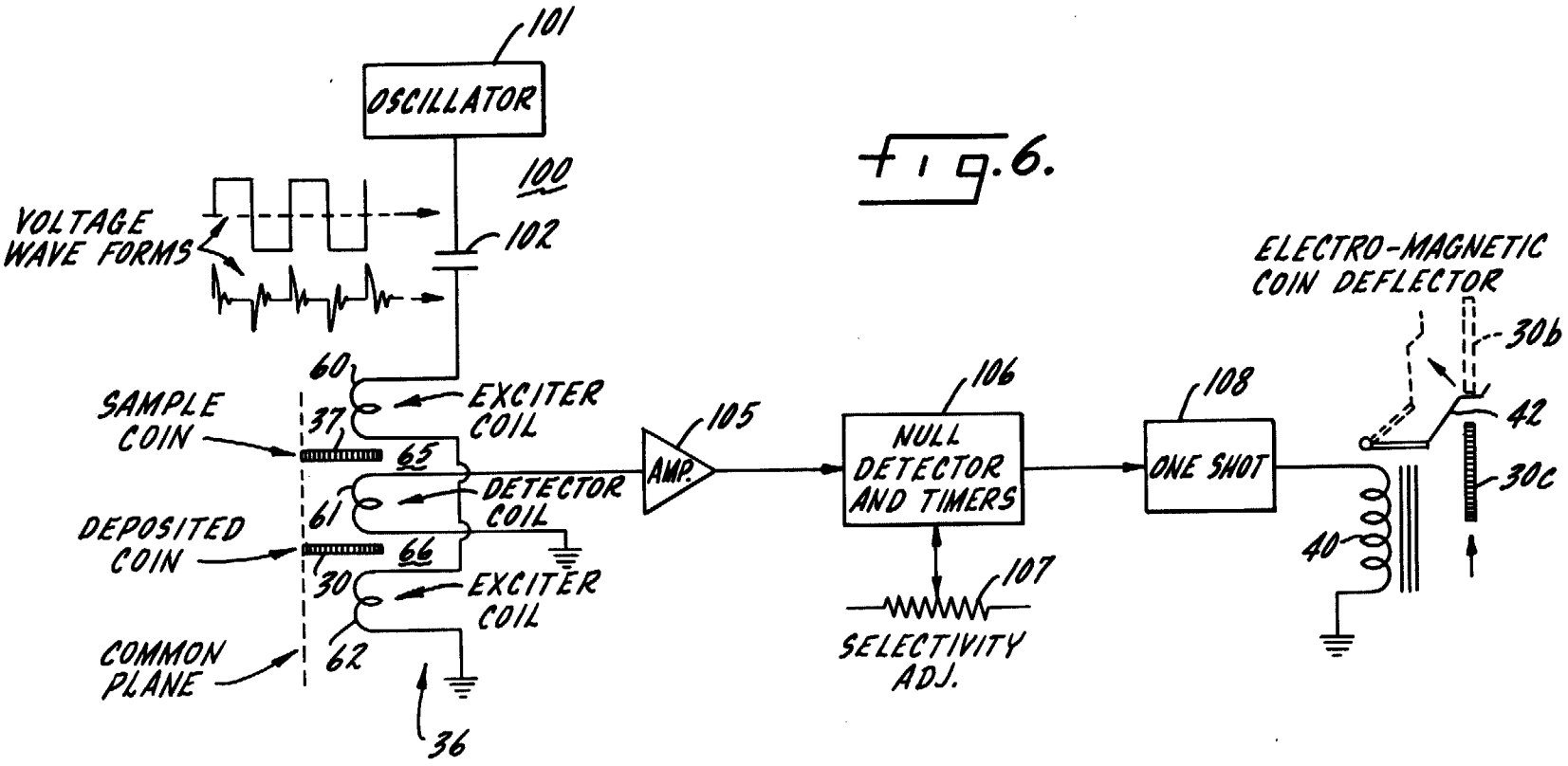
FIG. 6 is a block diagram illustrating a preferred form of the electronics.

The electronic exciting and detecting circuitry is broadly outlined in the block diagram of FIG. 6. The coil assembly 36 is schematically illustrated to the left of the drawing and includes exciter coils 60 and 62 and central detector coil 61. The sample coin 37 is schematically illustrated in the gap 65 while a test coin 30 is schematically illustrated in the other gap 66. The exciter coils are connected in series to receive the output of a spiked signal source generally indicated at 100. In the illustrated embodiment, the spiked signal source is comprised of an oscillator 101 for producing a square wave voltage as illustrated, and means for differentiating the square wave comprising a capacitor 102 connected in series between the oscillator and the exciter coils. The oscillator waveform before and after differentiation is illustrated in FIG. 6. It is seen that differentiation creates a spiked signal having a plurality of frequencies spanning the range to include what can be characterized as high frequencies and low frequencies. The low frequencies are at about the oscillator frequency which in one embodiment is selected at about 17 kilohertz, although obviously it can be varied over quite a wide range. The high frequencies are the actual spikes created by differentiating the edges of the square wave.

The multiple frequency signal is an important element in providing a tester capable of distinguishing coins of similar size but different material. It is found that some materials, typically those which are poor conductors such as lead attenuate higher frequencies to a greater extent than low frequencies, while other materials, typically good conductors such as silver attenuate in just the opposite fashion. Since the signal which drives the exciter coils has both high and low frequencies at different respective amplitudes, if a test coin of similar size but different material than the sample coin is passed through the magnetic field, in some portion of the frequency band it will be unable to attenuate the spiked signal to the same degree as the sample coin, and succeeding circuitry will respond to that by rejecting the coin.

As shown in FIG. 6, the central coil 61 is used as a detector coil, and the output is connected to an amplifier 105 which in turn feeds a null detector and timer arrangement 106. Associated with the block 106 is a selectivity adjustment 107 which can make the system more or less sensitive depending on the application.

With a sample coin in place and no test coin in the field, the detector coil 61 senses a large unbalance which drives the amplifier 105 to saturation. The amplifier output is actually following the spiked wave form coupled from the exciter coils to the detector coil, but the actual nature of the output depends on the material of the sample coin, as to whether primarily the high frequencies or low frequencies are reproduced. The null detector and timers 106 are insensitive to the large output from amplifier 105 in this quiescent mode.

When a test coin passes through the magnetic field in the gap 66, if it matches the sample coin, at some point during its travel it will create an interference in its gap 66 which matches the interference created by the sample coin 37 in its gap 65. As a result, the output of amplifier 105 will decrease toward zero as the null is approached and then return to its high quiescent level after the coin passes through. The null detector 106 senses that null and if its quality matches certain predetermined standards indicating the test coin matches the sample, it activates a one-shot multivibrator 108 to energize the solenoid 40 and draw the kicker 42 to the solid line position, thereby to deflect the coin into the coin box. In one embodiment of the invention, the one-shot 108 had a period of 50 milliseconds although that obviously can be varied to suit the circumstances.

Figure 7:
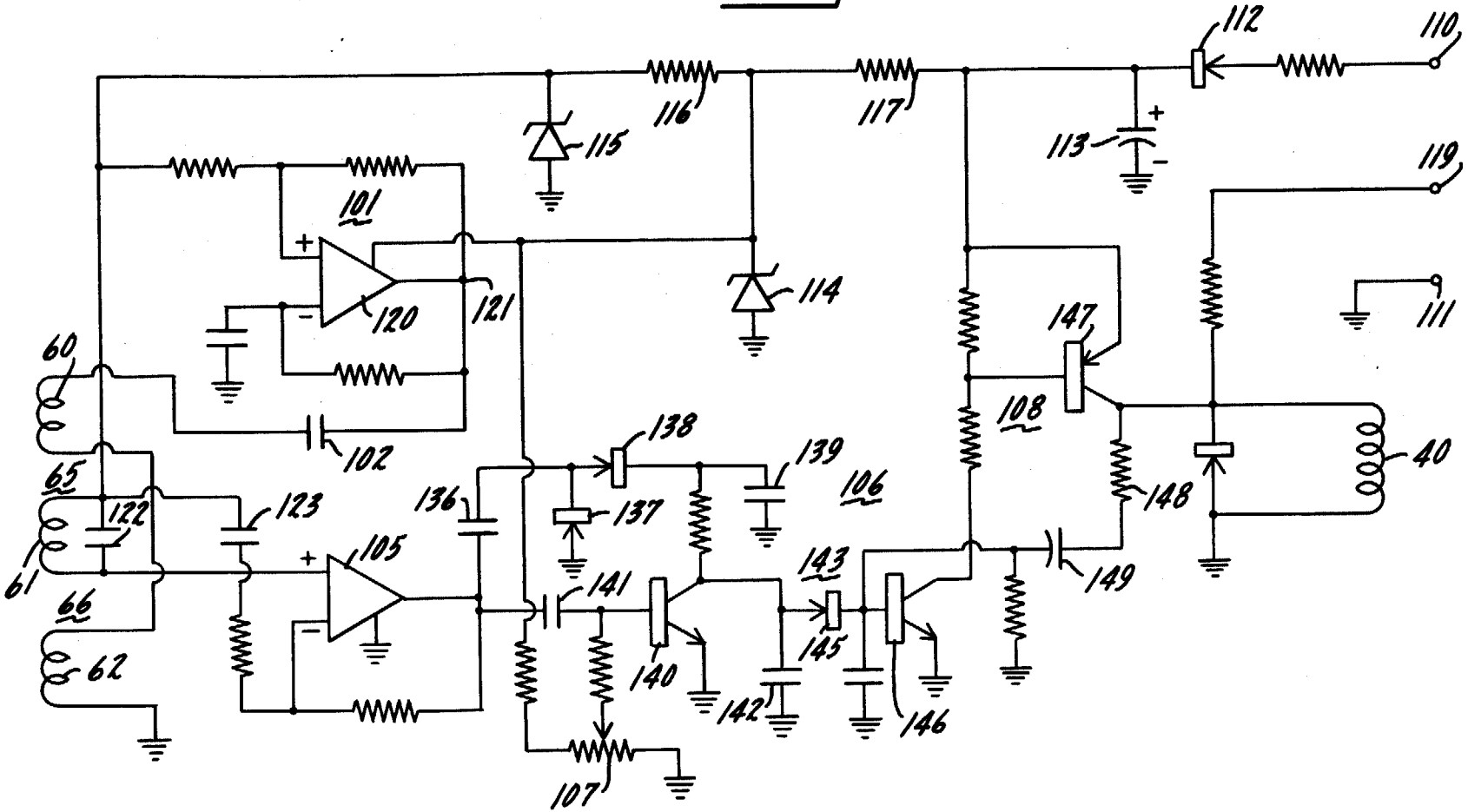
FIG. 7 is a circuit diagram detailing the electronics of FIG. 6.

The circuit diagram for an exemplary embodiment of the invention is illustrated in FIG. 7. A pair of terminals 110, 111 are connected to a suitable source of AC voltage, in one embodiment at 24 volts AC. The AC input is rectified by a diode 112 filtered by capacitor 113 and regulated by zener diodes 114, 115 and their associated dropping resistors 116, 117. In one embodiment zeners of 6 and 12 volt breakover voltage were used. The oscillator 101 is illustrated at the upper left of the drawing and includes conventional feedback elements to cause an amplifier 120 to produce a square wave output signal at 121 of 17 kilohertz in the illustrated embodiment. The differentiating capacitor 102 is shown connecting the amplifier output to the exciter coils 60, 62.

The detector coil 61 is magnetically coupled to the exciter coils 60, 62 via the magnetic fields in the gaps 65, 66. Some filtering is provided by a capacitor 122. The detector coil 61 thus serves to sense any difference in the magnetic fields in the gaps and couple a resulting signal by way of a capacitor 123 to the inverting input of the amplifier 105. The output of amplifier 105 thus is dependent on the balance or imbalance of the magnetic fields in the gaps 65, 66.

As noted above, with a sample coin in place and no test coin in place the output of amplifier 105 is driven to saturation because of the large imbalance. The null circuitry generally indicated at 106 treats that saturated condition as quiescent, and continues to monitor the amplifier to detect a null.

In accordance with the invention, the null detector circuitry 106 responds not only to the depth of the null, but also to its duration to provide superior selectivity. It is seen that the output of the amplifier 105 is connected through a capacitor 136 to a voltage doubler comprising diodes 137, 138 and a capacitor 139. Thus, in the quiescent condition when the output of amplifier 105 is switching very hard toward saturation in dependence on the high and/or low frequencies passed through the magnetic fields, the capacitor 139 is charged to its maximum level. However, as a test coin begins to enter the magnetic field, two things happen with respect to this portion of the circuitry. First of all, the circuit stops storing additional energy on the capacitor 139 as the output voltage of amplifier 105 begins to decrease. Secondly, the capacitor 139 actually begins to discharge as the null progresses. As will be described below, the energy stored in capacitor 139 is later used to trigger the circuitry which energizes the kicker magnet 40. Thus, if the null develops very slowly, there will not be sufficient energy left in capacitor 139 by the time the null reaches bottom to trigger the kicker and accept the coin. The circuitry acts as a form of timer and will reject any coin traveling below a predetermined rate down the common plane.

Returning to FIG. 7, it is seen that the capacitor 139 is connected in the collector circuit of a transistor 140 which has a base coupled through a capacitor 141 to the output of amplifier 105. In the quiescent condition when the output of amplifier 105 is switching hard into saturation, transistor 140 is also saturated. In that condition a capacitor 142 in the level sensing circuitry 143 remains discharged.

As noted above, when a test coin begins to pass through the magnetic field, the peak swing of the amplifier 105 begins to decrease as the system begins to enter a null. As a result, the voltage doubler stops charging capacitor 139. However, the amplifier signal is sufficient to keep switching transistor 140 into saturation. Actually, the transistor turns off briefly during each cycle of the spiked waveform, but the capacitor 142 prevents the collector from increasing in voltage. At any rate, when the system begins to enter the null, the capacitor 139 stops charging although the transistor 140 remains on. Thus, there is a path for capacitor 139 to discharge through resistor 144 and the collector-emitter of the transistor. That continues until the null reaches a low threshold level at which time the output of amplifier 105 will no longer be able to maintain transistor 140 conductive. At that time the energy remaining in capacitor 139 is available to charge capacitor 142 in the level sensing circuitry 143. If sufficient energy remains to charge capacitor 142 to a threshold of about 1.2 volts established by a diode 145 and the base-emitter junction of transistor 146, the transistor 146 in the one-shot multivibrator 108 will switch on. That in turn will switch on the transistor 147 and both will remain conductive for a predetermined interval determined primarily by the time constant of resistor 148 and capacitor 149. It is seen that the solenoid 40 for the kicker arm 42 is connected in the collector circuit of the transistor 147 and thus will be energized during the time the one-shot 108 is on. The transistor 148 also outputs a signal on terminal 119 to indicate to the coin operated device that a coin has been accepted.

Figures 8A, 8B, 8C, 8D:
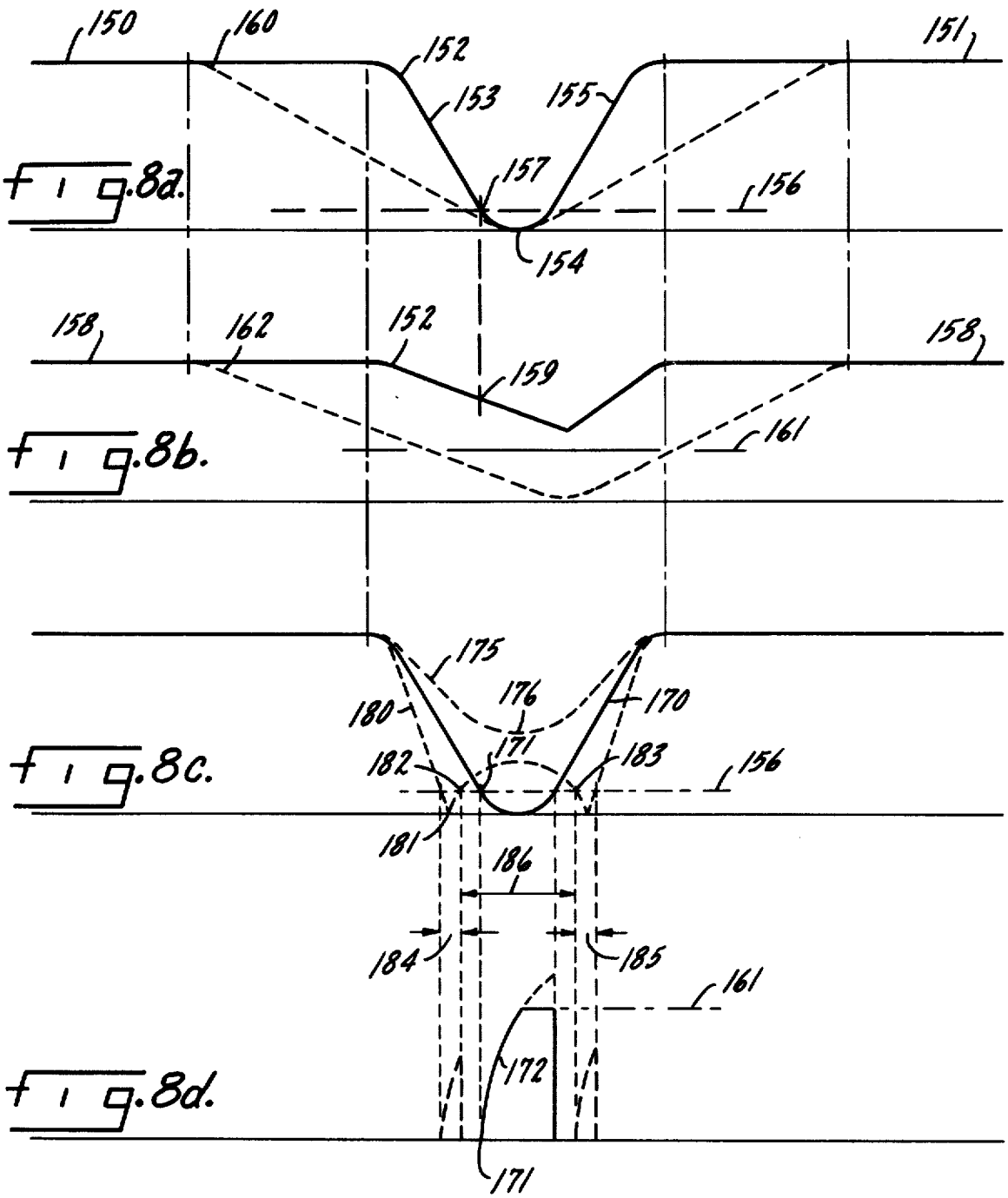

The operation of the circuitry will be better appreciated with reference to the waveforms of FIG. 8. It is noted that the waveforms of FIGS. 8*a* and 8*c* are simplified to the extent they show merely the envelope of the spiked signal rather than the spiked signal itself.

Referring to the solid line portion of FIG. 8*a*, the quiescent state of the envelope output of amplifier 105 is illustrated generally at 150 and 151. At about point 152, the the system begins to enter a null illustrated as a decrease in the envelope of the output signal. In normal operation the decrease is at a comparatively rapid rate as shown at 153 down toward a minimum value 154. The envelope output of amplifier 105 then swings back toward the quiescent level as shown at 155 as the sample coin leaves the gap between the magnets, returning to the quiescent level at 151.

A horizontal line 156 represents a threshold level (adjustable by means of the resistor 107) below which the output of amplifier 105 will fail to switch the transistor 140 on. Accordingly, the transistor 140 will turn off at about the point indicated as 157 allowing triggering of the one-shot if sufficient energy remains on the capacitor 139.

The solid line portion of FIG. 8*b* illustrates the voltage on capacitor 139 which corresponds to the null cycle illustrated in FIG. 8*a*. It is seen that the high quiescent voltage is maintained on the capacitor at 139 when the system is not in null. At the point 152 at which the null commences, it is seen that the voltage on capacitor 139 begins to decrease toward a threshold level (the aforementioned 1.2 volts) illustrated at 161. At the time denoted by reference numeral 157 the voltage on capacitor 139 is above the threshold 161, such that when the transistor 140 switches off sufficient energy remains on capacitor 139 to charge capacitor 142 to a level capable of triggering the one-shot 108. As a result, the coin will be accepted.

The dashed line portions of FIGS. 8*a* and 8*b* illustrate circuit operation with a coin traveling below acceptable speed. The quiescent levels remain the same, but the null begins much sooner, at the point indicated by reference numeral 160. FIG. 8*b* demonstrates that capacitor 139 begins discharging at that same time. FIG. 8*a* shows that the amplifier output switches below the threshold 156 at about the same point 157 described in connection with a proper coin. However, by that time, the capacitor voltage illustrated in FIG. 8*b* is below the threshold 161. Accordingly, there is insufficient energy to transfer from capacitor 139 to capacitor 142 to trigger the one-shot 108 and the coin will pass harmlessly into the reject chute.

FIGS. 8*c* and 8*d* illustrate the passage of coins at the appropriate speed but having differing attenuation characteristics. The solid line portion of FIG. 8*c* indicated at 170 is very much like the solid line portion of FIG. 8*a*, and represents the situation where the test coin matches the sample coin. At the point 171 the output of amplifier 105 switches through the threshold level 156 associated with the transistor 140, causing the transistor to switch off. FIG. 8*d* represents the voltage on capacitor 142. At the time 171 at which the transistor 140 switches off the voltage on the capacitor 142 begins to build up as indicated at 172. The reference level of the leveldetecting circuitry associated with transistor 146 is illustrated in a different scale at 161. It is seen that with a coin of proper characteristics traveling at proper speed the voltage 172 reaches the level 161 thereby triggering the oneshot.

The dashed line waveform 175 represents a coin with insufficient attenuation to create a sufficiently deep null. It is seen that at the very bottom 176 of the null, the envelope of the amplifier output is still above the threshold 156 associated with transistor 140. Thus, the transistor 140 will not switch off, the charge will not be transferred from capacitor 139 to capacitor 142, the one-shot will not be triggered, and the coin will not be accepted.

Wave form 180 illustrates the condition on the opposite extreme where the attenuation of the test coin is much greater than that of the sample coin. The output envelope of the amplifier will actually reach zero at 181 then swing positive at 182 again passing through the threshold and causing transistor 140 to again become conductive. The waveform then decreases passing through the threshold 156 again at 183 causing transistor 140 to again switch off. Thus, it is seen that the two brief intervals identified as 184, 185 at which the transistor 140 is switched off are separated by a larger interval 186 in which the transistor is conductive. The effect on capacitor 142 is illustrated in FIG. 8*d*. It is seen that the capacitor charges for the brief interval 184, but as soon as transistor 140 again switches on at point 182 quickly discharges and remains discharged until the point 183 is reached. At that time the capacitor again begins to charge for another brief interval. It is seen that neither of the brief intervals is long enough to allow the capacitor voltage to reach the threshold 161, and thus the one-shot will not be triggered and the coin will be rejected.

As a way of testing the selectivity of a coin tester constructed in accordance with this invention, a slug was prepared containing the same metals as a U.S. quarter. The only difference between the two is that the nickel on the slug was electrodeposited whereas that in a quarter is sandwiched. The prototype coin tester had a real quarter inserted as a sample coin and reliably and consistently accepted quarters and rejected the slug.

We claim:

1. A coin tester for comparing a test coin to a sample coin and accepting those that match comprising in combination a spiked signal source having a plurality of frequency components, means for creating a magnetic field from the spiked signal source, means for positioning the sample coin in the magnetic field, means for establishing a path for passing the test coin through the magnetic field, and means for sensing the magnitude and duration of the change in the magnetic field caused by the test coin as a measure of the similarity or difference between the coins, wherein the spiked signal source comprises an oscillator for generating a square wave signal and means for differentiating the square wave signal to generate the spiked signal.

2. A coin tester comprising in combination an oscillator, means for spiking the oscillator output to produce an alternating signal having a plurality of frequency components, means for creating a magnetic field from the spiked signal, means for positioning a sample coin in the magnetic field for comparison with a test coin, means for establishing a path for passing the test coin through the magnetic field to create a null for said comparison, means for storing energy when no test coin is in the magnetic field and for releasing said energy as a test coin passes through the magnetic field, and means responsive to the amount of stored energy and magnitude of the null for determining if the test coin matches the sample coin.

3. A coin tester comprising in combination, a square wave oscillator, means for spiking the oscillator output to create a spiked signal having a plurality of frequency components, means for creating a magnetic field from the spiked signal, means for positioning a sample coin in the magnetic field for attenuating certain ones of the frequency components in the magnetic field, means for establishing a path for passing a test coin through the magnetic field for attenuating certain of said frequency components, means for storing energy when no test coin is in the magnetic field and for releasing said energy as a test coin passes through the magnetic field, means for producing a null signal as the test coin passes the sample coin, and means responsive to the amount of stored energy at the time a null is produced for accepting or rejecting the test coin.

4. The coin tester as set out in claim 3 wherein the means for storing energy is a capacitor connected to be charged when no test coin is in the magnetic field and discharged when a test coin is in the magnetic field.

5. The improvement as set out in claim 4 wherein there is further provided a pendulum damper for engaging the test coin prior to its entry into the magnetic field, said pendulum damper so constructed and arranged as to provide a variable retarding force dependent on coin size.

* * * * *